US006240383B1

(12) United States Patent
Tanaka

(10) Patent No.: US 6,240,383 B1
(45) Date of Patent: May 29, 2001

(54) CELP SPEECH CODING AND DECODING SYSTEM FOR CREATING COMFORT NOISE DEPENDENT ON THE SPECTRAL ENVELOPE OF THE SPEECH SIGNAL

(75) Inventor: Seiko Tanaka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/122,768

(22) Filed: Jul. 27, 1998

(30) Foreign Application Priority Data

Jul. 25, 1997 (JP) ..... 9-199994

(51) Int. Cl.[7] ..... G10L 19/04; G10L 11/02
(52) U.S. Cl. ..... 704/219; 704/233
(58) Field of Search ..... 704/219, 233

(56) References Cited

U.S. PATENT DOCUMENTS 5,664,055 * 9/1997 Kroon ..... 704/223
5,689,615 * 11/1997 Benyassine et al. ..... 704/219
5,809,460 * 9/1998 Hayata et al. ..... 704/225
5,978,761 * 11/1999 Johansson ..... 704/226
6,108,623 * 8/2000 Morel ..... 704/219

FOREIGN PATENT DOCUMENTS 7-115403 5/1995 (JP) ..... H04B/14/04
7-334197 12/1995 (JP) ..... G10L/9/14
8-139688 5/1996 (JP) ..... H04B/14/04
10-143199 5/1998 (JP) ..... G10L/9/14

OTHER PUBLICATIONS

Furui, "Digital Speech Processing, Chapter 5, Linear Prediction Analysis" *Tokai Daigaki Shuppan* pp. 60–67 or Marcel Dekker, Inc., p. 85–95.

* cited by examiner

*Primary Examiner*—William R. Korzuch
*Assistant Examiner*—Tālivaldis Ivars Šmits
(74) *Attorney, Agent, or Firm*—Foley & Lardner

(57) ABSTRACT

A speech coding and decoding system consisting of a speech coding system and a speech decoding system, the speech coding system comprises a low pass filter using an LPC parameter, and an efficient coding processing unit for generating a coded speech signal by referring to a code book for a speech signal when coding a speech and generating a noise signal by referring to the code book for the signal filtered by the low pass filter when coding the information other than a speech, the speech decoding system comprises an efficient decoding processing unit for decoding the coded signal supplied from the speech coding system so to reproduce a speech signal, and a high pass filter using the LPC parameter for filtering a speech signal of an unvoiced sound area generated by the efficient decoding processing unit.

13 Claims, 6 Drawing Sheets

CELP SPEECH CODING AND DECODING SYSTEM FOR CREATING COMFORT NOISE DEPENDENT ON THE SPECTRAL ENVELOPE OF THE SPEECH SIGNAL

BACKGROUNDS OF THE INVENTION

1. Field of the Invention

The present invention relates to a speech coding and decoding system for use in a digital data radio transmission technique for a mobile communication such as PDC (Personal Digital Cellular Telecommunication Systems) or the like, and more particularly to a speech coding and decoding system which has a VOX (Voice Operated Transmitter) function of judging a speech sound (e.g., sound when speaking)or a no-speech sound (e.g., sound when not speaking, that is, the interval between speech) in a signal from a transmitter, so to create a background noise depending on the speech sound/no-speech sound. Background noise means the background sounds other than the speech regardless of the speech sound and no-speech sound. That is, the speech and background noise are included in the speech sound. The no-speech sound is only a background noise.

2. Description of the Related Art

This kind of speech coding and decoding system consists of a speech coding system for coding an input sound and transmitting the same and a speech decoding system for decoding the coded signal received from the speech coding system and reproducing speech. The structure of the speech coding system is shown in FIG. 5 and the structure of the speech decoding system is shown in FIG. 6.

With reference to FIG. 5, the conventional speech coding system 50 comprises a speech/no-speech sound judging unit 51 for judging whether an input speech signal belongs to a speech sound or a no-speech sound, so to supply its discriminate signal, an LPC analyzing unit 52 for calculating an LPC (Linear Predictive Coding) parameter for the input speech signal, an efficient coding processing unit 53 for performing coding processing based on the LPC parameter, a unique word generating unit 54 for supplying a unique word control signal depending on the type of the input speech signal, and a switch controller 55 for performing a switching control upon receipt of the discriminate signal supplied from the speech/no-speech sound judging unit 51, the coded speech signal supplied from the efficient coding processing unit 53, and the unique word control signal supplied from the unique word generating unit 54. Of the above components, as a unique word control signal, the unique word generating unit 54 supplies a preamble signal when an input speech signal belongs to a speech sound, and supplies a postamble signal when an input speech signal belongs to a no-speech sound. The switch controller 55 supplies a preamble signal and a coded speech signal as a coded signal in case of a speech sound and supplies a postamble signal and a background noise as a coded signal in case of a no-speech sound, according to the discrimination result of a speech sound or a no-speech sound by a discriminate signal. However, the background noise is only supplied by the first frame, and thereafter only a postamble signal is supplied.

With reference to FIG. 6, the conventional speech decoding system 60 comprises a speech/no-speech sound judging unit 61 receiving a coded signal supplied from the speech coding system 50 for judging whether the speech based on the coded signal belongs to a speech sound or a no-speech sound, an LPC decoding unit 63 for decoding the LPC parameter, and an efficient decoding processing unit 64 for supplying a speech signal decoded by use of the LPC parameter calculated by the LPC decoding unit 63. Of the above components, the speech/no speech sound judging unit 61 makes a judgement whether it is a speech sound or a no-speech sound based on a unique word control signal included in an input coded signal, that is a preamble signal or a postamble signal. When it is judged to be a speech sound, the input coded signal is sent to the LPC decoding unit 63. When it is judged to be a no-speech sound, if one frame of a background noise has been included in the input coded signal, the background noise is sent to a background noise storing unit 62 to be stored therein. After storing the background noise into the background noise storing unit 62, if no background noise has been included in the input coded signal, the background noise stored in the background noise storing unit 62 is delivered to the LPC decoding unit 63.

The technique concerned with the above conventional speech coding and decoding is disclosed in, for example, Japanese Patent Publication Laid-Open (Kokai) No. Heisei 7-115403 "Coding and Decoding Circuit of Unvoiced Area Information", No. 7-334197 "Speech Coding System", No. 8-139688 "Speech Coding System".

The above publication No. 7-115403 discloses a technique in which a coding circuit comprises a frequency characteristic extracting unit for extracting frequency characteristic from an analog to digital converted signal to make a pattern, and a minimum error pattern judging unit, having a noise pattern group, for selecting a noise pattern most approximate to the output pattern of the frequency characteristic extracting unit, while a decoding circuit comprises a noise characteristic convolutional operation circuit for performing a convolutional operation of the received and detected minimum error pattern and a white noise pattern, thereby eliminating the risk of deterioration in the quality of a reproduced signal and also eliminating unnecessary processing.

The above publication No. 7-334197 discloses a technique in which speech parameter processing means mounted on a speech coding system voids a long predictive delay depending on the past state in the speech parameters and processes the long predictive gain into a minimum quantized value, to provide an output, thereby enabling a decoding system to create a surrounding noise interpolating in a period of receiving no coded data by use of the coded data received at a constant interval.

The above publication No. 8-139688 discloses a technique for controlling a background noise, comprising an acoustic weighting filter for providing an acoustic weighting speech signal after switching a speech signal or one of the LPF output of a speech signal so to receive it based on the VOX mode information, an electric power quantizer for supplying an electric power index obtained from the long time average of the electric power at the time of a no-speech state based on the VOX mode information, an LPC analyzer for supplying the LPC controlled at an inherent value at the time of a no-speech state, an LPC quantizer for supplying a quantized LSP index and a quantized LPC in case of fixing the LPC at the inherent value at the time of a no-speech state, and an adapted code book retrieval unit for controlling an adapted code book index at the inherent value at the time of a no-speech state, so as not to perform retrieval processing.

In the conventional speech coding and decoding system shown in FIGS. 5 and 6, the speech coding system discriminates between a speech sound and a no-speech sound in an input speech signal, thereafter calculates an LPC parameter regardless of a speech sound or a no-speech sound, and refers to a code book as for the speech. As for noise other than the speech, vocal code data, and pitch data, it refers to a code book after filtering through a synthetic filter.

However, since the code book is created based on the speech sound characteristics, it is not suitable for a reference of noise characteristic at the time of a no-speech sound. Generally, spectrum characteristic of a sound differs at the time of a speech sound (e.g., a person talking) and a no-speech sound (e.g., a person not talking). Namely, at the time of a speech sound, a plurality of mountain-shaped spectral shapes are produced in a spectrum and at the time of a no-speech sound, a flat-shaped spectrum is produced. Since the conventional code book for use in spectrum coding is created based on the spectrum characteristic of speech at the time of a speech sound, it is not adequate to use the code book as for a noise at the time of a no-speech sound having the different characteristic from the speech sound. If noise at the time of a no-speech sound is compulsorily referred to the code book, it is coded into noise having completely different characteristic from the inherent noise and decoding of such noise will produce an incongruous background noise.

A sense of incongruity in the background noise after decoding may be caused by referring to the code book created based on the sound characteristic at the time of a speech sound, as for noise at the time of a no-speech sound having a different sound characteristic from a speech sound. Even in the speech coding and decoding system based on the CELP (Code-book Excited Linear Prediction) method having a VOX function of discriminating between a speech sound and a no-speech sound of a transmitter, a sense of incongruity is similarly felt in the decoded background noise.

SUMMARY OF THE INVENTION

An object of the present invention is, in order to solve the above problem, to provide a speech coding and decoding system capable of decreasing a sense of incongruity in the background noise produced at the time of a no-speech sound.

According to one aspect of the invention, a speech coding and decoding system includes a speech coding system for coding a speech signal and transmitting the same and a speech decoding system receiving the coded signal transmitted from the speech coding system for decoding the same to supply speech.

The speech coding system includes a first filtering means for filtering the information other than speech of an input speech signal through a filter using an LPC parameter calculated from the input speech signal.

The speech coding system also includes a coding processing means for generating a coded speech signal by referring to a code book created based on speech characteristics at the time of a sound when coding speech, and generating a noise signal by referring to the code book for the coded signal filtered by the first filtering means when coding the information other than speech.

The speech decoding system includes a decoding processing means receiving the coded signal supplied from a switch control means of the speech coding system for decoding the same to generate a speech signal.

The speech decoding system also includes a second filtering means for filtering the speech signal generated by the decoding processing means, through a filter using the LPC parameter calculated from the input coded signal in a no-speech interval of the input coded signal.

In the preferred construction, the speech coding system further includes a first speech/no-speech sound judging means for discriminating between a speech interval and a no speech interval in an input speech signal, and an LPC analyzing means for calculating an LPC parameter as for the input speech signal by use of a linear prediction analysis method in a speech interval, according to the judgement by the first speech/no speech sound judging means.

In the preferred construction, the first filtering means of the speech coding system includes an LPC storing means for temporarily storing the LPC parameter for a sound at the time just before switching from a speech interval to a no-speech interval, according to the judgement by the first speech/no speech sound judging means, and a low pass filter for filtering the information other than speech of the input speech signal, by use of the LPC parameter stored in the LPC storing means as a filter coefficient.

In the preferred construction, the speech coding system further includes a first speech/no speech sound judging means for discriminating between a speech interval and a no-speed interval in an input speech signal, and an LPC analyzing means for calculating an LPC parameter as for the input speech signal by use of a linear prediction analysis method in a speech interval, according to the judgement by the first speech/no speech sound judging means.

The first filtering means includes an LPC storing means for temporarily storing the LPC parameter for a sound at the time just before switching from a speech interval to no-speech interval, according to the judgement by the first speech/no-speech sound judging means, and a low pass filter for filtering the information other than speech of the input speech signal by use of the LPC parameter stored in the LPC storing means as a filter coefficient.

In a second preferred construction, the speech decoding system includes a second speech/no-speech sound judging means receiving the coded signal supplied from a switch control means of the speech coding system for discriminating between a speech interval and a no-speech interval, and an LPC decoding means for calculating an LPC parameter based on the input coded signal in a speech interval, according to the judgement by the second speech/no-speech sound judging means.

In a third preferred construction, the speech decoding system includes a second speech/no-speech sound judging means as in the second preferred construction, and where the second filtering means includes an LPC storing means for temporarily storing the LPC parameter calculated by the LPC decoding means, and a high pass filter for filtering the speech signal decoded by the decoding processing means by use of the LPC parameter stored in the LPC storing means as a filter coefficient.

In a fourth preferred construction, the speech coding system further includes a first speech/no-speech sound judging means as in the first preferred construction, and a first filtering means as in the first preferred construction.

The speech decoding system of the fourth preferred construction includes a second speech/no-speech sound judging means receiving the coded signal supplied from a switch control means of the speech coding system for discriminating between a speech interval and no-speech interval, and an LPC decoding means for calculating an LPC parameter based on the input coded signal in a speech interval, according to the judgement by the second speech/no speech sound judging means.

The second filtering means of the fourth preferred construction includes an LPC storing means for temporarily storing the LPC parameter calculated by the LPC decoding means, and a high pass filter for filtering the speech signal decoded by the decoding processing means, by use of the LPC parameter stored in the LPC storing means as a filter coefficient.

In a fifth preferred construction, the speech coding system further comprises a unique word generating means for supplying a unique word control signal for discriminating between a speech interval and no-speech interval in a coded signal supplied from the coding processing means, and an output switching means for supplying a coded speech signal generated by the coding processing means as well as a unique word control signal indicating a speech interval, which is supplied from the unique word generating means, during a speech interval, and supplying a noise signal generated by the coding processing means as well as a unique word control signal indicating a no-speech interval, which is supplied from the unique word generating means, during a no-speech interval, according to the judgement by the first speech no-speech sound judging means.

The speech decoding system of the fifth preferred construction further includes a second speech/no-speech sound judging means receiving a coded signal supplied from a switch control means of the speech coding system for discriminating a speech interval and a no-speech interval based on the unique word control signal included in the input coded signal.

Also, the speech coding system further includes a first speech/no-speech sound judging means and an LPC analyzing means as in the first preferred construction. The speech coding system further includes a unique word generating means for supplying a unique word control signal for discriminating between a speech interval and a no-speech interval in a coded signal supplied from the coding processing means, and an output switching means for supplying a coded speech signal generated by the coding processing means as well as a unique word control signal indicating a speech interval, which is supplied from the unique word generating means, during a speech interval, and supplying a noise signal generated by the coding processing means as well as a unique word control signal indicating a no-speech interval, which is supplied from the unique word generating means, during a no-speech interval, according to the judgement by the first voiced/unvoiced sound judging means.

The first filtering means is as described in the first preferred construction.

The speech decoding system includes a second speech/no-speech sound judging means and an LPC decoding means of the second preferred construction.

According to another aspect of the invention, a speech coding and decoding method in a speech coding and decoding system consisting of a speech coding system for coding a speech signal and transmitting the same and a speech decoding system receiving the coded signal transmitted from the speech coding system for decoding the same to supply speech. The method includes the steps of in the speech coding system, a step of discriminating between a speech interval and a no-speech interval in an input speech signal.

In case of a speech interval in the judgement result, a step of generating a coded speech signal by referring to a code book created based on speech characteristics at the time of a no-speech interval as for a speech signal to be coded.

In case of a no-speech interval in the judgement result, a step of filtering the information other than a speech of an input speech signal, through a filter using an LPC parameter calculated from the input speech signal.

A step of generating a noise signal by referring to the code book for the coded signal filtered.

Also, a step of supplying the decoded speech signal or the noise signal while switching the decoded speech signal and the noise signal according to the judgement result.

While, in the speech decoding system, a step of discriminating between a speech interval and a no-speech interval upon receipt of a code signal supplied from a switch control means of the speech coding system.

A step of decoding the input coded signal to generate a speech signal.

In case of a no-speech interval in the judgement result, a step of filtering the generated speech signal, through a filter using an LPC parameter calculated from the input coded signal.

In the preferred construction, the filtering step in the speech coding system includes a step of temporarily storing the LPC parameter for a speech sound at the time just before switching from a speech interval to a no-speech interval, according to the judgement in the speech/no-speech sound judging step, and a step of filtering the information other than a speech of the input speech signal, by use of the stored LPC parameter as a filter coefficient.

In the preferred construction, the filtering step in the speech coding system includes a step of temporarily storing the LPC parameter calculated from the input coded signal in a speech interval, according to the judgement in the speech/no-speech sound judging step, and a step of filtering the decoded speech signal, by use of the stored LPC parameter as a filter coefficient.

In another preferred construction, the filtering step in the speech coding system includes a step of temporarily storing the LPC parameter for a speech sound at the time just before switching from a speech interval to a no-speech interval, according to the judgement in the speech/no-speech sound judging step, and a step of filtering the information other than a speech of the input speech signal, by use of the stored LPC parameter as a filter coefficient.

The filtering step in the speech decoding system includes a step of temporarily storing the LPC parameter calculated from the input coded signal in a no-speech interval, according to the judgement in the speech/no-speech sound judging step, and a step of filtering the decoded speech signal, by use of the stored LPC parameter as a filter coefficient.

Other objects, features and advantages of the present invention will become clear from the detailed description given herebelow.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

The preferred embodiment of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
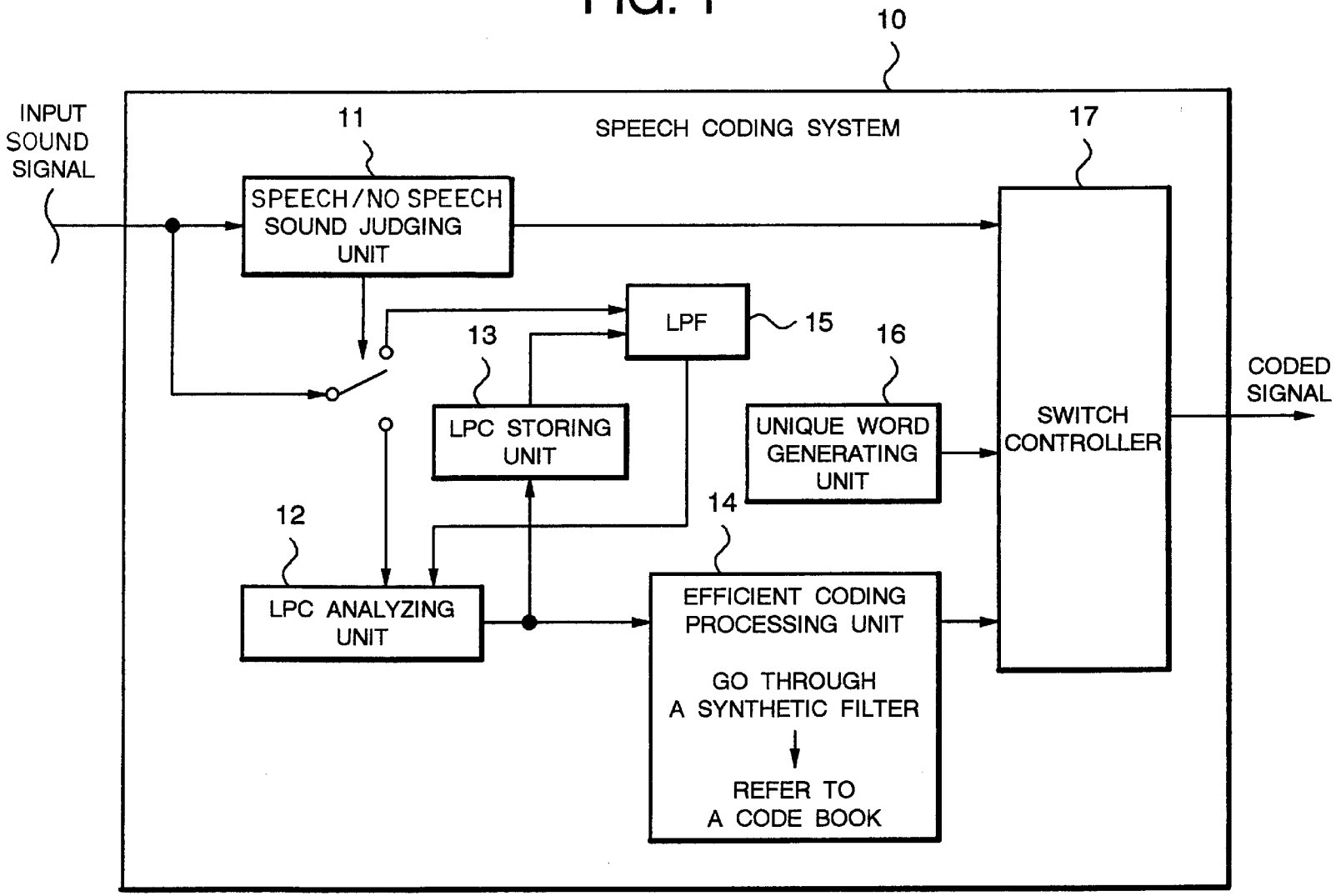
FIG. 1 is a block diagram showing the structure of a speech coding system according to an embodiment of the present invention.

FIG. 1 is a block diagram showing the structure of the speech coding system of a speech coding and decoding system according to an embodiment of the present invention. With reference to FIG. 1, the speech coding system 10 of the embodiment comprises a speech/no-speech sound judging unit 11 for judging whether an input speech signal belongs to a speech sound or a no-speech sound, and supplying its discriminate signal, an LPC analyzing unit 12, an LPC storing unit 13, an efficient coding processing unit 14, and an LPF (low pass filter) 15 for coding the input speech signal, a unique word generating unit 16 for supplying a unique word control signal depending on the type of the input speech signal, and a switch controller 17 for receiving the discriminate signal supplied from the speech/no-speech sound judging unit 11, the coded speech signal supplied from the efficient coding processing unit 14, and the unique word control signal supplied from the unique word generating unit 16, to do a switching control. FIG. 1 shows only the characteristic components of the embodiment, while the description of the other general components is omitted there.

Of the above components, the speech/no-speech sound judging unit 11 may be realized by, for example, a program-controlled CPU and an internal memory. The unit 11 discriminates between a speech interval and a no-speech interval in the input speech signal and supplies a discriminate control signal depending on the judgement results. When the speech signal is judged to be of a speech interval, the relevant input speech signal is sent to the PLC analyzing unit 12, while when the speech signal is judged to be of a no-speech interval, a noise of the input speech signal is sent to the LPF 15.

The LPC analyzing unit 12 may be realized by, for example, a program-controlled CPU and an internal memory. The unit 12 calculates an LPC parameter in an input speech signal by use of a linear prediction analysis method and converts the obtained LPC parameter into an LSP (Line Spectrum Pair) parameter. The obtained LSP parameter is sent to the efficient coding processing unit 14.

The LPC storing unit 13 may be realized by, for example, an internal memory, which temporarily stores the LPC parameter at the time of the speech sound just before the switching when the discriminate signal issued by the speech/no-speech sound judging unit 11 is switched from a speech sound to a no-speech sound. Namely, the LPC storing unit 13 stores the output which has been LPC analyzed by the LPC analyzing unit 12 at the time of a speech sound, as the LPC parameter. The stored LPC parameter is supplied as the filter coefficient of the LPF 15.

The LPF 15 may be realized by, for example, a program-controlled CPU and an internal memory. It receives a noise of an input speech signal when the input speech signal belongs to a no-speech sound based on the LPC parameter stored in the LPC storing unit 13, and filters the same, so as to approximate this noise characteristic to a noise characteristic at the time of a speech sound, thereby creating a background noise for use in a linear prediction analysis method. The LPF 15 has a VOX function for discriminating between a speech sound indicating vocalization of a transmitter and a no-speech sound indicating no vocalization thereof and creates a background noise by approximating the spectrum characteristic of a noise accompanying a no-speech sound to the spectrum characteristic of a noise accompanying a speech sound, according to the CELP method.

The efficient coding processing unit 14 may be realized by, for example, a program-controlled CPU and an internal memory, which performs coding processing based on the LSP parameter and supplies a coded speech signal or noise signal. The efficient coding processing unit 14 refers to a code book created based on the speech characteristic at the time of a speech sound for the input speech signal. More specifically, it refers to the code book through a synthetic filter based on the LPC parameter as for the vocal information and the sound source information other than the speech information, including noise. After filtering by HPF (High Pass Filter) is performed on the vocal information and the sound source information other than the speech information, including a noise supplied from the LPC analyzing unit 12, in order to eliminate the signals less than 40 Hz, inherent signals of a speech, filtering by a synthetic filter based on the filter coefficient calculated by the LPC analysis is further performed thereon, and the reference processing to the existing code book (created based on the speech characteristic at the time of a speech sound) is performed on the obtained signals. However, when the input speech signal belongs to a no-speech sound, since the noise has been once filtered through the LPF 15, to eliminate a high frequency, there is a possibility of noise characteristic appearing again if a filtering through the HPF. In this case, the HPF processing in the efficient coding processing unit 14 should be saved, or filtering should be performed with the filter coefficient changed to an appropriate value.

The unique word generating unit 16 may be realized by, for example, a program-controlled CPU and an internal memory. The unit 16 supplies a unique word control signal for use in each control corresponding to a speech interval or a no-speech interval in decoding the coded speech signal or noise signal. More specifically, as a unique word control signal, when the input speech signal belongs to a speech interval, a preamble signal is supplied, and when it belongs to a no-speech interval, a postamble signal is supplied.

The switch controller 17 may be realized by, for example, a program-controlled CPU and an internal memory. It supplies a preamble signal and a coded speech signal as a coded signal in case of a speech sound, and it supplies a postamble signal and a background noise as a coded signal in case of a no-speech sound, according to the discriminate control signal supplied from the speech/no-speech sound judging unit 11.

In the speech coding system 10 of the embodiment, whether an input speech signal belongs to a speech sound or a no-speech sound is judged by the speech/no speech sound judging unit 11. In case of a speech sound, the LPC parameter of the input speech signal is calculated by the LPC analyzing unit 12, and the obtained LPC parameter is stored in the LPC storing unit 13. The LPC-analyzed input speech signal is coded by the efficient coding processing unit 14 and delivered to the switch controller 17 as a coded speech signal. When the input speech signal belongs to a no-speech sound, the LPC parameter at the time of a speech sound stored in the LPC storing unit 13 is filtered by the LPF 15, for use in requiring a filter coefficient of the synthetic filter in the LPC analyzing unit 12. At this time, since the LPF 15 makes use of the speech characteristic of a speech sound at the time previous to the switching to a no-speech sound, it enables the noise characteristic at the time of a no-speech sound to approach the speech characteristic in the natural state. Also in this case, the LPC analyzed input speech signal is coded by the efficient coding processing unit 14 and delivered to the switch controller 17 as a noise signal.

Figure 3:
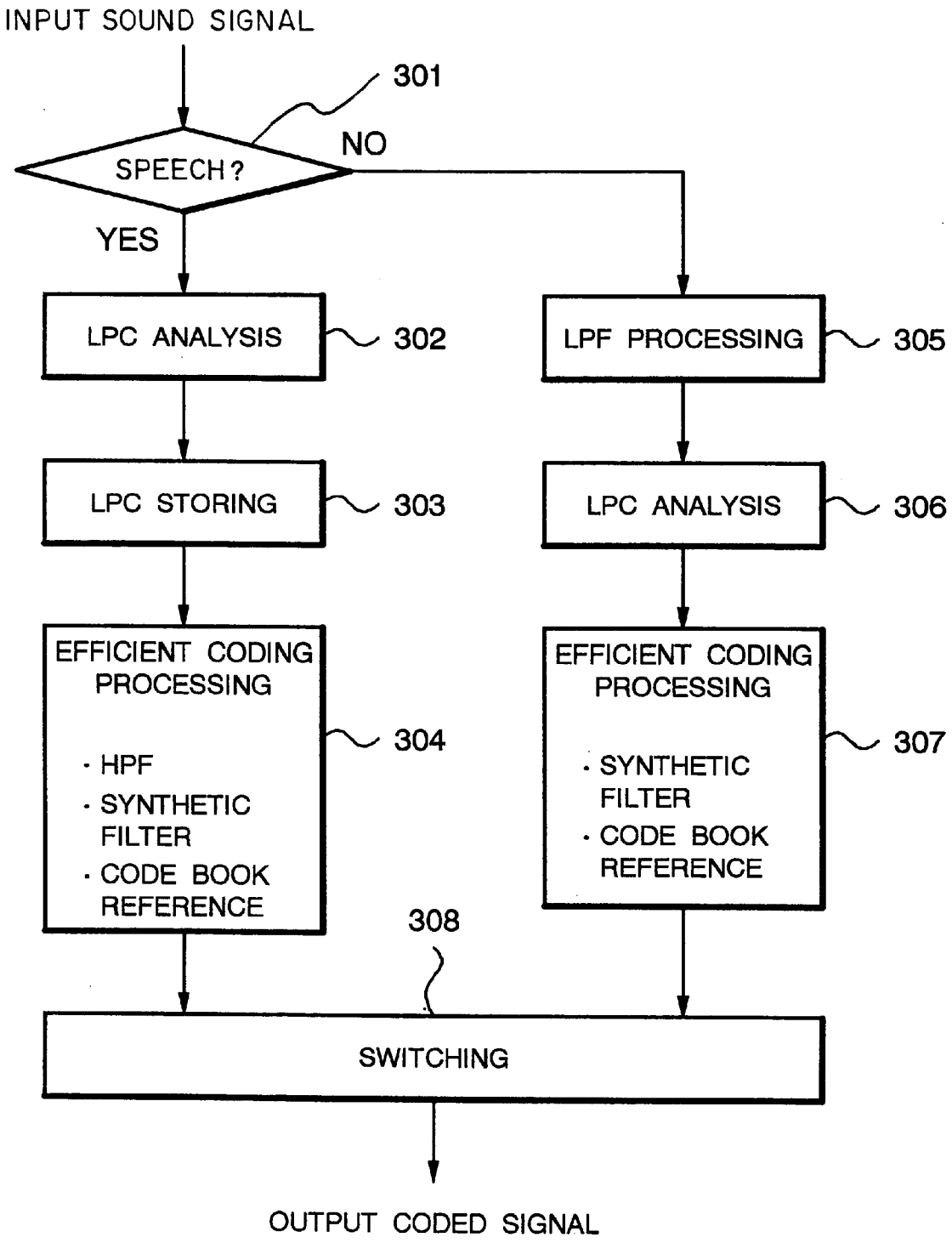
FIG. 3 is a flow chart showing the operation of the speech coding system according to the embodiment.

FIG. 3 is a flow chart showing the operation of the speech coding system 10. With reference to FIG. 3, the speech/no-speech sound judging unit 11 judges an input speech signal whether it belongs to a speech sound or a no-speech sound (Step 301). When the input speech signal belongs to a speech sound, after the LPC analyzing unit 12 requires an LPC parameter through the LPC analysis (Step 302), the LPC storing unit 13 stores the LPC parameter (Step 303) and the efficient coding processing unit 14 performs efficient coding processing including filtering by the HPF, filtering by the synthetic filter, and code book reference (Step 304). The switch controller 17 performs a switching control and supplies the input coded speech signal and preamble signal as a coded signal (Step 308).

When the input speech signal belongs to a no-speech sound, a noise of the input speech signal is filtered through the LPF 15 which has the filter coefficient of the LPC parameter stored in the LPC storing unit 13 in Step 303 (Steps 301 and 305). Thereafter, the LPC analyzing unit 12 performs the LPC analysis on the output signal of the LPF 15 (Step 306) and the efficient coding processing unit 14 performs the efficient coding processing, similarly to the case of the speech sound (Step 307). The switch controller 17 receives the coded noise signal to do a switching control and supply the postamble signal and the background noise as a coded signal (Step 308).

Figure 2:
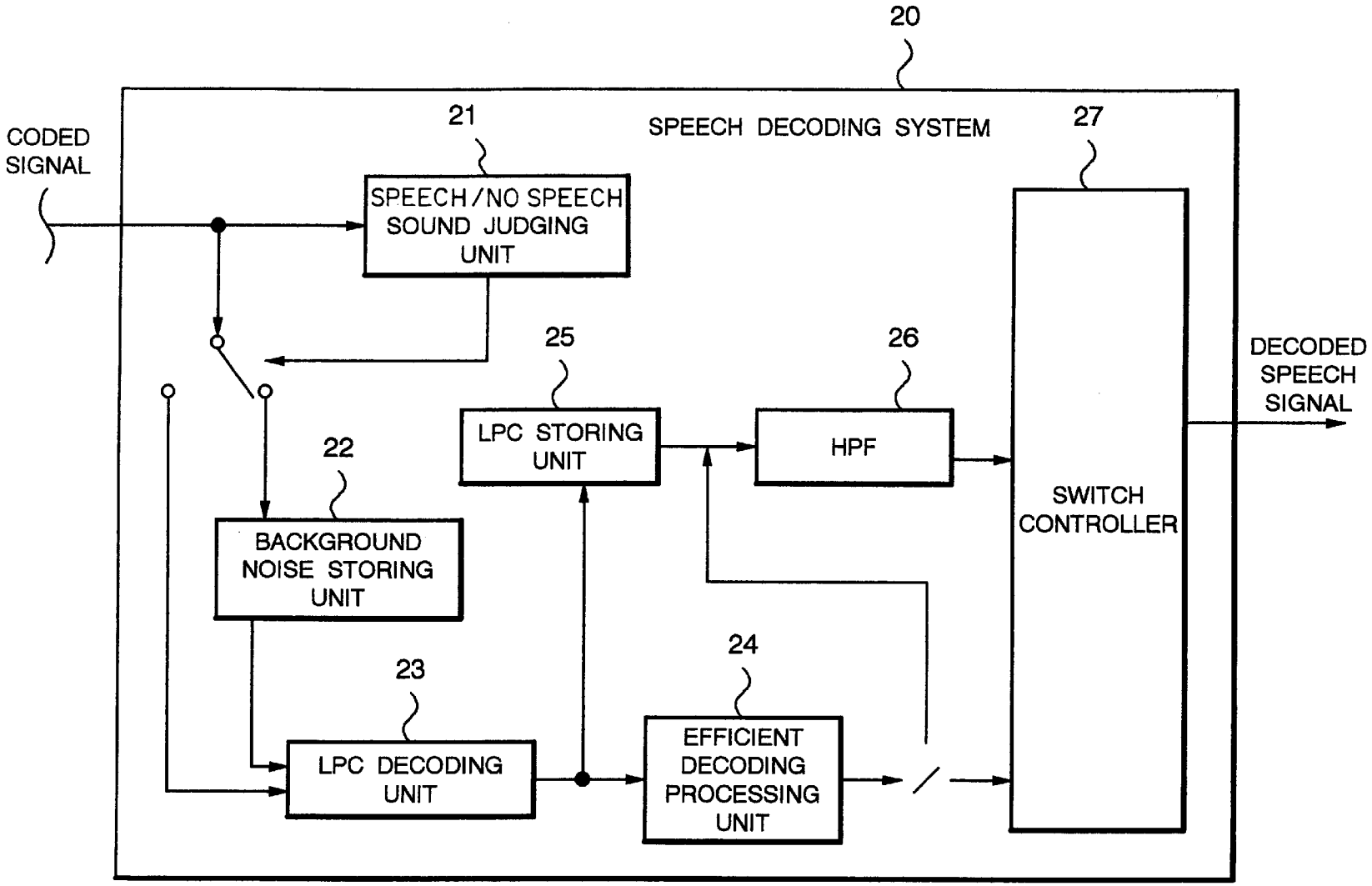
FIG. 2 is a block diagram showing the structure of a speech decoding system according to an embodiment of the present invention.

FIG. 2 is a block diagram showing the structure of a speech decoding system in the speech coding and decoding system according to an embodiment of the present invention. With reference to FIG. 2, the speech decoding system 20 of the embodiment comprises a speech/no-speech sound judging unit 21 for receiving the coded signal supplied from the speech coding system 10 so as to judge the speech based on the coded signal whether it belongs to a speech sound or a no-speech sound, a background noise storing unit 22, an LPC decoding unit 23, an efficient decoding processing unit 24, an LPC storing unit 25, and an HPF (High Pass Filter) 26 for decoding the coded signal to obtain a speech signal, and a switch controller 27 for performing a switching control upon receipt of the output of the efficient decoding processing unit 24 and the HPF 26. FIG. 2 shows only the characteristic components of the embodiment, and the description of the other general components is omitted there.

Of the above components, the speech/no-speech sound judging unit 21 may be realized by, for example, a program-controlled CPU and an internal memory. It judges whether a unique word control signal included in the input coded signal is a preamble signal or a postamble signal, and according to the judgement result, a speech sound or a no-speech sound can be distinguished. When the unique word control signal is a preamble signal, it is judged to be a speech sound, and when it is a postamble signal, it is judged to be a no-speech sound. When the judgement results in a speech signal, the input coded signal is delivered to the LPC decoding unit 23. When the judgement results in a no-speech signal, the input coded signal (that is, a coded signal of a background noise) is delivered to the background noise storing unit 22.

The background noise storing unit 22 may be realized by, for example, an internal memory, which stores one frame of the coded signal of the background noise when the input coded signal belongs to a no-speech sound.

The LPC decoding unit 23 may be realized by, for example, a program-controlled CPU and an internal memory, which performs decoding processing of the LPC parameter included in the coded signal when the input coded signal belongs to a speech sound. The decoded LPC parameter is delivered to the efficient decoding processing unit 24 and the LPC storing unit 25.

The efficient decoding processing unit 24 decodes the input coded signal by use of the LSP parameter decoded by the LPC decoding unit 23 and outputs a speech signal or a noise signal. More specifically, the efficient decoding processing unit 24 refers to a code book for the vocal information and the sound source information other than the speech information after filtering the same through the synthetic filter based on the LPC parameter.

The LPC storing unit 25 may be realized by, for example, an internal memory, which stores the LSP parameter decoded by the LPC decoding unit 23 when the discriminate control signal issued by the speech/no-speech sound judging unit 21 belongs to a speech sound. The stored LPC parameter is supplied as the filter coefficient of the HPF 26.

The HPF 26 may be realized by, for example, a program-controlled CPU and an internal memory. It supplies a background noise through filtering the noise signal, when the input coded signal belongs to a speech sound, based on the LPC parameter stored in the LPC storing unit 25. The HPF 26 has a VOX function of discriminating between a speech sound indicating the vocalization of a transmitter and a no-speech sound indicating no speech thereof, and creates a background noise by approximating the spectrum characteristic of a noise accompanying a no-speech sound to the spectrum characteristic of a noise accompanying a speech, according to the CELP method.

The switch controller 27 may be realized by, for example, a program-controlled CPU and an internal memory. It supplies the speech signal decoded by the efficient decoding processing unit 24 in case of a speech sound and supplies the background noise output from the HPF 26 in case of a no-speech sound, according to the discriminate control signal supplied from the speech/no-speech sound judging unit 21.

In the speech decoding system 20 of the embodiment, whether the coded signal supplied from the speech coding system 10 belongs to a speech sound or a no-speech sound is judged by the speech/no-speech sound judging unit 21. In case of a speech sound or when the coded signal includes a preamble signal, an LPC parameter of the coded signal is calculated by the LPC decoding unit 23 and the obtained LPC parameter is stored in the LPC storing unit 25. The coded signal is decoded by the efficient decoding processing unit 24 and sent to the switch controller 27 as a speech signal. In case of a no-speech sound or when the coded signal includes a postamble signal, the background noise for one frame included in the coded signal is stored in the background noise storing unit 22. Thereafter, when it is judged to be a no-speech sound by the speech/no-speech sound judging unit 21, the background noise stored in the background noise storing unit 22 is delivered to the LPC decoding unit 23, decoded by the efficient decoding processing unit 24, thereafter filtered through the HPF 26 by use of the LPC parameter at the time of a speech sound stored in the LPC storing unit 25, and delivered to the switch controller 27 as a background noise.

Figure 4:
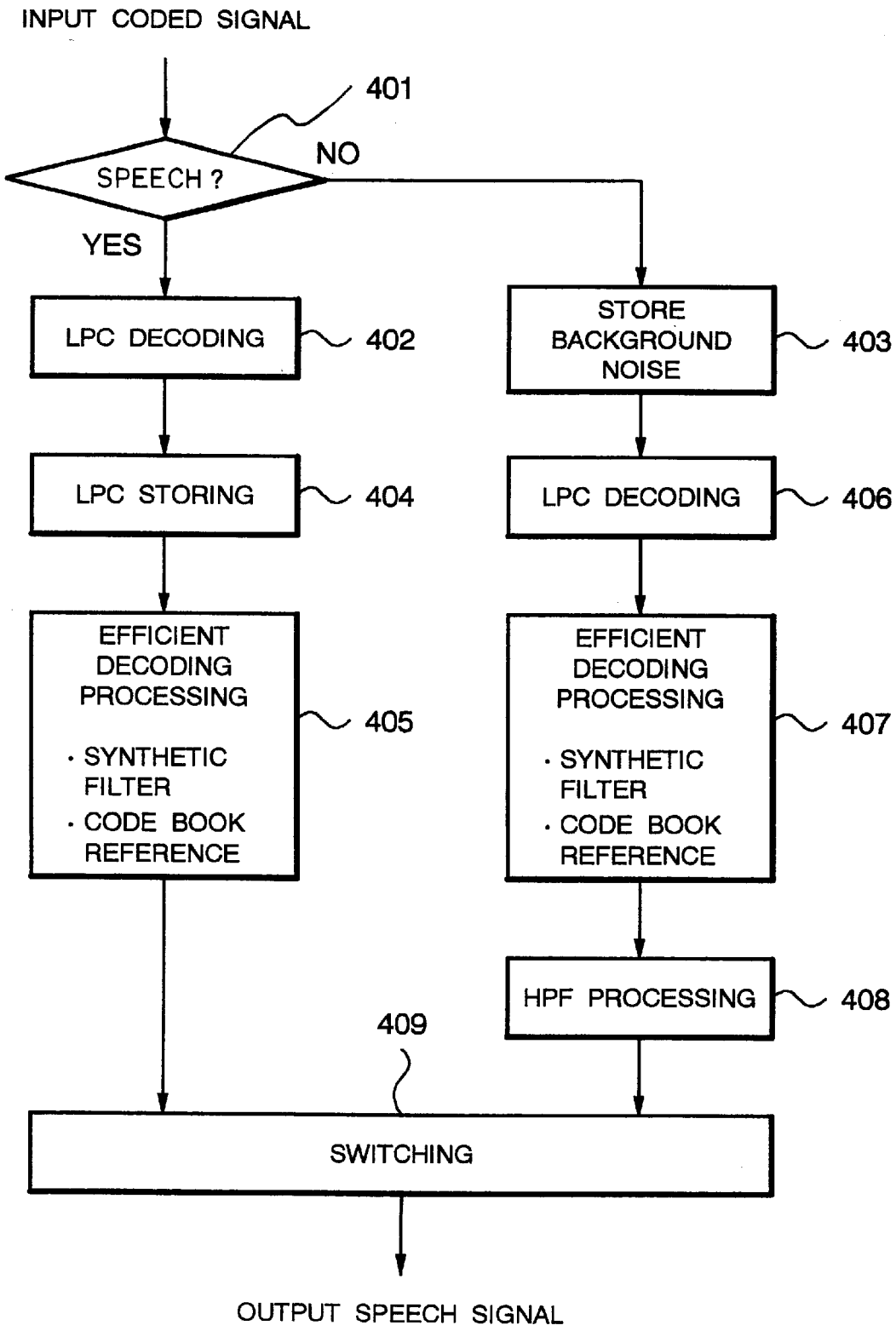
FIG. 4 is a flow chart showing the operation of the speech decoding system according to the embodiment.
Figure 5:
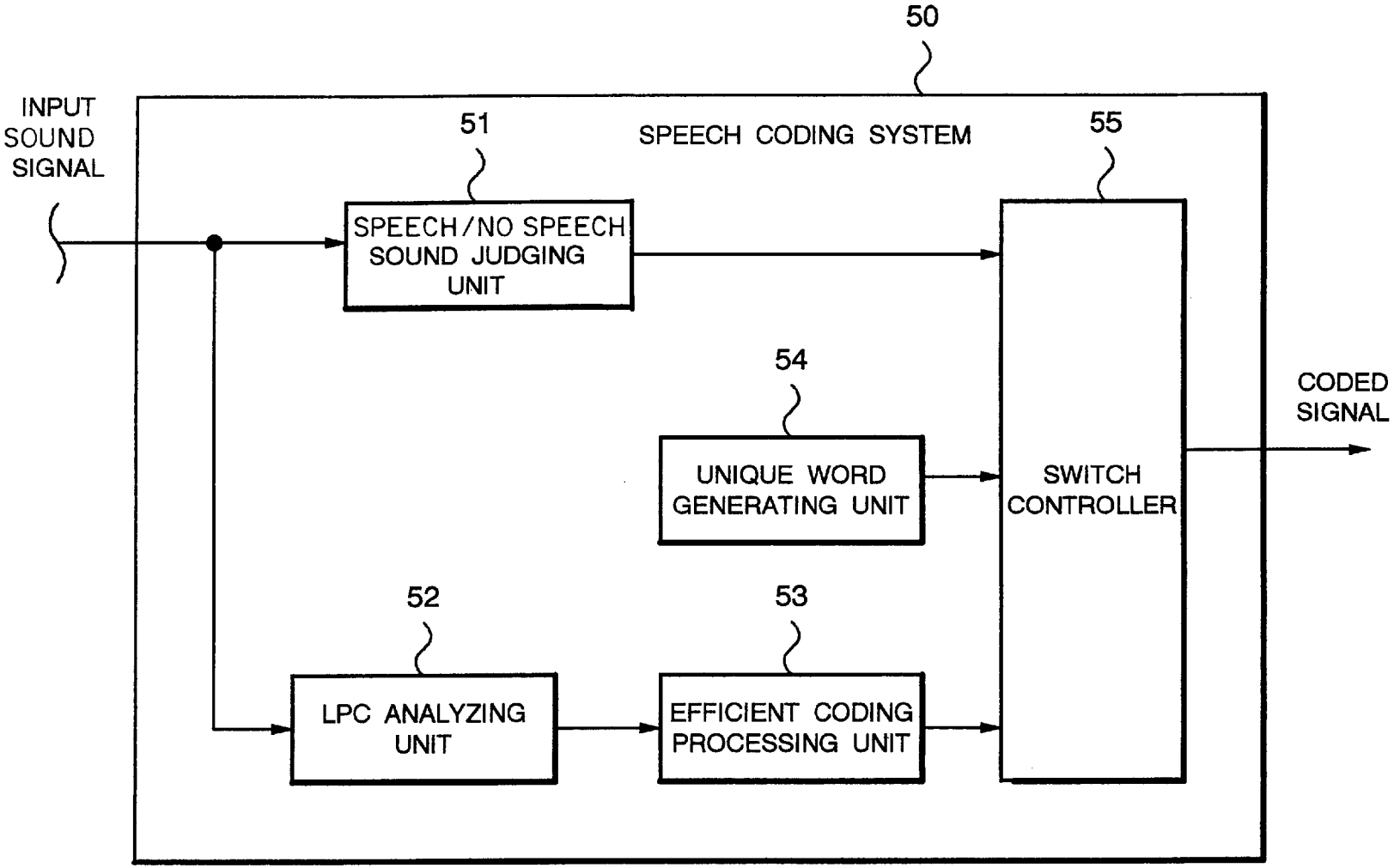
FIG. 5 (PRIOR ART)
FIG. 5 is a block diagram showing the structure of the conventional speech coding system.
Figure 6:
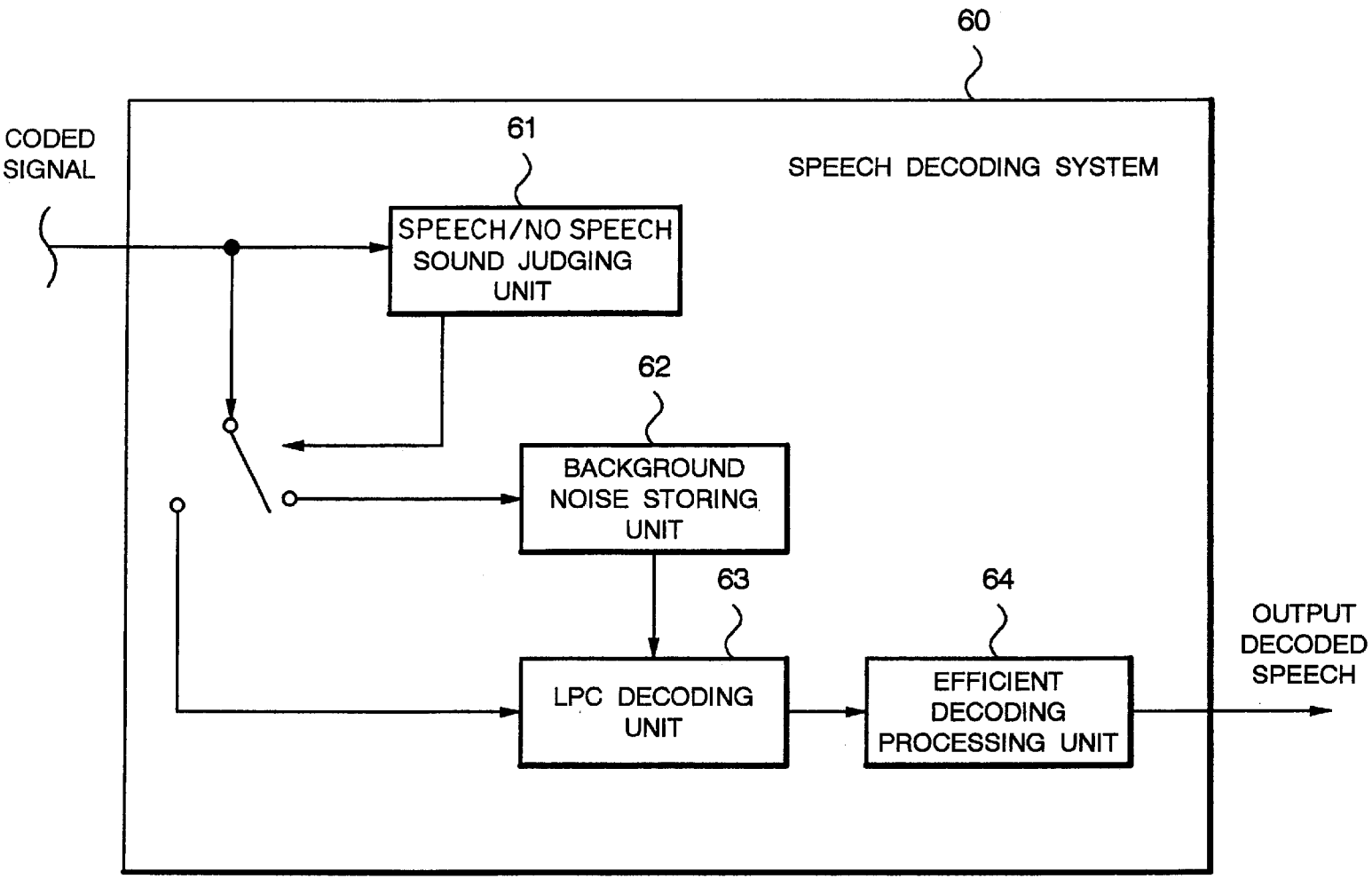
FIG. 6 (PRIOR ART)
FIG. 6 is a block diagram showing the structure of the conventional speech decoding system.

FIG. 4 is a flow chart showing the operation of the speech decoding system 20. With reference to FIG. 4, the speech/no-speech sound judging unit 21 judges an input coded signal whether it belongs to a speech sound or a no-speech sound based on the unique word control signal (Step 401). When the input coded signal belongs to a speech sound, after the LPC decoding unit 23 calculates an LPC parameter through the LPC decoding (Step 402), the LPC storing unit 25 stores the LPC parameter (Step 403) and the efficient decoding processing unit 24 performs the efficient decoding processing including filtering by the synthetic filter and code book reference and reproduces a speech signal (Step 404). The switch controller 27 performs a switching control and supplies the input decoded speech signal (Step 409).

On the other hand, when the input coded signal belongs to a no-speech sound, the background noise storing unit 22 stores the background noise for one frame included in the coded signal (Step 405). Thereafter, since the transmission of a background noise from the speech coding system 10 is broken, the speech decoding system 20 continues receiving a signal other than the background noise. This signal is judged to be a no-speech sound by the speech/no-speech sound judging unit 21. Therefore, the LPC decoding unit 23 calculates an LPC parameter based on the background noise delivered from the background noise storing unit 22 (Step 406), and the efficient decoding processing unit 24 performs the efficient decoding processing (Step 407). After the HPF 26 having the filter coefficient of the LPC parameter of the LPC storing unit 25 filters the output of the efficient decoding processing unit 24 (Step 408), the switch controller 27 performs a switching control, so to supply the background noise output from the HPF 26 (Step 409).

The speech decoding system 20 needs no unique word control signal so as to control the operation of the switch controller 27 because the transmission timing is sequentially switched by the speech/no-speech sound judging unit 21 of the first stage.

The details of the LPF 15 of the speech coding system 10 and the HPF 26 of the speech decoding system 20 will be described this time. Assuming that the filter coefficient created by the LPC analyzing unit 12 of the speech coding system 10 is defined as ai (i=0 to Np: where Np is the order of the LPC), the coefficient of the transmission H(Z) of the synthetic filter using the same filter coefficient $\alpha i$ can be expressed as follows:

$$H(Z)=1/(1+\Sigma\alpha i\cdot Z\hat{}(-1)) \quad (1)$$

The above formula (1) is generally used in the coding processing of a speech signal and described in, for example, Chapter 5, "Linear Prediction Analysis" of the "Digital Speech Processing" (written by Furui, published by Tokai Daigaku Shuppan). However, since the noise spectrum has a flat shape, it cannot be coded well if using the formula (1).

Then, coding makes easy by the filtering through the LPF 15. The filter coefficient A(Z) of the LPC 15 is expressed as follows:

$$A(Z)=1/(1+\Sigma\lambda\hat{}i\alpha i\cdot Z\hat{}(-1)) \quad (2)$$

Where, $N \leqq Np0$, $\lambda$ is a constant in the range of $0<\lambda<<1$. The noise spectrum in this case becomes flatter according as it is approaching to "0", decreasing the effect of the filtering, and according as it is approaching to "1", it becomes a spectrum of periodical mountain shape. Since the filter coefficient A'(Z) of the HPF 26 uses the inverse (inverse filter), it can be expressed as follows:

$$A'(Z)=1+\Sigma\lambda\hat{}i\cdot\alpha i\cdot Z\hat{}(-1) \quad (3)$$

As set forth hereinabove, according to the speech coding and decoding system of the present invention, in the speech coding system, an input signal at the time of a no-speech sound is filtered by use of the LPC parameter at the time of a voiced sound through the LPC analysis and thereafter coded with reference to a code book, thereby making it possible to approximate the spectrum characteristic of a noise to the spectrum characteristic of a speech, and in the speech decoding system, after decoding processing of the coded signal, a natural background noise can be created by the filtering, in case of a no-speech sound, through an inverse filter using the LPC parameter at the time of a speech sound. Namely, by approximating the spectrum characteristic of a background noise to the spectrum characteristic of a speech, a suitable code book can be selected in a reference to a code book, thereby decreasing the sense of incongruity in the background noise reproduced at the time of a no-speech sound extremely.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A speech coding and decoding method in a speech coding and decoding system that includes a speech coding system for coding a speech signal and transmitting the same and a speech decoding system receiving the coded signal transmitted from the speech coding system for decoding the same to supply speech, the method comprising:

in the speech coding system, discriminating between a speech interval and a no-speech interval in an input sound signal, in case of a speech interval in the judgement result, generating a coded speech signal by referring to a code book created based on speech characteristics at the time of a speech sound as for a speech signal to be coded, in case of a no-speech interval in the judgement result, filtering the information other than speech of an input sound signal, through a filter using LPC parameters calculated from the input speech signal, generating a noise signal by referring to the code book for the coded signal filtered, and supplying the decoded speech signal or the noise signal while switching the decoded speech signal and the noise signal according to the judgement result, wherein, in the speech decoding system, discriminating between a speech interval and a no-speech interval upon receipt of a code signal supplied from a switch control means of the speech coding system, decoding the input coded signal to generate a speech signal, and in case of a speech interval in the judgement result, filtering the generated speech signal, through a filter using LPC parameters calculated from the input coded signal.

2. A speech coding and decoding method as claimed in claim 1, wherein said filtering step in the speech coding system comprises:

temporarily storing the LPC parameters for a sound at the time just before switching from a speech interval to a no-speech interval, according to the judgement in said speech/no-speech sound judging step, and filtering the information other than speech of the input sound signal, by use of the stored LPC parameters as a filter coefficient.

3. A speech coding and decoding method as claimed in claim 1, wherein said filtering step in the speech coding system comprises:

temporarily storing the LPC parameters calculated from the input coded signal in a speech interval, according to the judgement in said speech/no-speech sound judging step, and filtering the decoded speech signal, by use of the stored LPC parameters as a filter coefficient.

4. A speech coding and decoding method as claimed in claim 1, wherein said filtering step in the speech coding system comprises:

temporarily storing the LPC parameters for a sound at the time just before switching from a speech interval to a no-speech interval, according to the judgement in said speech/no-speech sound judging step, and filtering the information other than speech of the input sound signal, by use of the stored LPC parameters as a filter coefficient, wherein said filtering step in the speech decoding system comprises:

temporarily storing the LPC parameters calculated from the input coded signal in a speech interval, according to the judgement in said speech/no-speech sound judging step, and filtering the decoded speech signal, by use of the stored LPC parameters as a filter coefficient.

5. A speech coding and decoding system that includes a speech coding system for coding a speech signal and transmitting the same and a speech decoding system receiving the coded signal transmitted from the speech coding system for decoding the same to supply speech, wherein said speech coding system comprising:

a first speech/no-speech sound judging means for discriminating between a speech interval and a no-speech interval in an input sound signal;

an LPC storing means for temporarily storing LPC parameters for a speech sound at a time just before switching from a speech interval to a no-speech interval, according to the judgement by said first speech/no-speech sound judging means;

a first filtering means for filtering the information other than speech of the input speech signal, by use of the LPC parameters stored in said LPC storing means as a filter coefficient;

a coding processing means for generating a coded speech signal by referring to a code book created based on speech characteristics at the time of a speech sound when coding speech, and generating a noise signal by referring to the code book for the coded signal filtered by said first filtering means when coding the information other than speech; and a switch control means for supplying a coded speech signal generated by said coding processing means, during a speech interval, and supplying a noise signal generated by said coding processing means, during a no-speech interval, according to the judgement by said first speech/no-speech sound judging means; and said speech decoding system comprising:

a decoding processing means receiving the coded signal supplied from said switch control means of the speech coding system for decoding the same to generate a speech signal; and a second filtering means for filtering the speech signal generated by said decoding processing means, through a filter using the LPC parameters calculated from the input coded signal for a no-speech interval of the input coded signal.

6. A speech coding and decoding system as set forth in claim 5, wherein said speech coding system further comprises, an LPC analyzing means for calculating LPC parameters for the input sound signal by use of a linear prediction analysis method in a speech interval, according to the judgement by said first speech/no-speech sound judging means.

7. A speech coding and decoding system as set forth in claim 1, wherein said first filtering means of the speech coding system comprises a low pass filter for filtering the information other than speech of the input sound signal.

8. A speech coding and decoding system as set forth in claim 5, wherein said speech coding system further comprises:

an LPC analyzing means for calculating LPC parameters for the input sound signal by use of a linear prediction analysis method in a speech interval, according to the judgement by said first speech/no-speech sound judging means, and said first filtering means comprises:

a low pass filter for filtering the information other than speech of the input sound signal.

9. A speech coding and decoding system as set forth in claim 5, wherein said speech decoding system comprises:

a second speech/no-speech sound judging means receiving the coded signal supplied from a switch control means of the speech coding system for discriminating between a speech interval and a no-speech interval, and an LPC decoding means for calculating LPC parameters based on the input coded signal in a speech interval, according to the judgement by said second speech/no-speech sound judging means.

10. A speech coding and decoding system as set forth in claim 5, wherein said speech decoding system comprises:

a second speech/no-speech sound judging means receiving the coded signal supplied from a switch control means of the speech coding system for discriminating between a speech interval and a no-speech interval, and an LPC decoding means for calculating LPC parameters based on the input coded signal in a speech interval, according to the judgement by said second speech/no-speech sound judging means, and said second filtering means comprises:

an LPC storing means for temporarily storing the LPC parameters calculated by said LPC decoding means, and a high pass filter for filtering the speech signal decoded by said decoding processing means by use of the LPC parameters stored in said LPC storing means as a filter coefficient.

11. A speech coding and decoding system as set forth in claim 5, wherein said speech coding system further comprises:

an LPC analyzing means for calculating LPC parameters for the input sound signal by use of a linear prediction analysis method in a speech interval, according to the judgement by said first speech/no-speech sound judging means, and said first filtering means comprises:

a low pass filter for filtering the information other than speech of the input sound signal, and said speech decoding system comprises:

a second speech/no-speech sound judging means receiving the coded signal supplied from a switch control means of the speech coding system for discriminating between a speech interval and a no-speech interval, and an LPC decoding means for calculating LPC parameters based on the input coded signal for a speech interval, according to the judgement by said second speech/no-speech sound judging means, and said second filtering means comprises:

an LPC storing means for temporarily storing the LPC parameters calculated by said LPC decoding means, and a high pass filter for filtering the speech signal decoded by said decoding processing means, by use of the LPC parameters stored in said LPC storing means as a filter coefficient.

12. A speech coding and decoding system as set forth in claim 5, wherein said speech coding system further comprises:

a unique word generating means for supplying a unique word control signal for discriminating between a speech interval and a no-speech interval in a coded signal supplied from said coding processing means, wherein said switch control means supplies a coded speech signal generated by said coding processing means as well as a unique word control signal indicating a speech interval, which is supplied from said unique word generating means, during a speech interval, and supplies a noise signal generated by said coding processing means as well as a unique word control signal indicating a no-speech interval, which is supplied from said unique word generating means, during a no-speech interval, according to the judgement by said first speech/no-speech sound judging means, while said speech decoding system further comprises:

a second speech/no-speech sound judging means receiving a coded signal supplied from a switch control means of the speech coding system for discriminating a speech interval and a no-speech interval based on the unique word control signal included in the input coded signal.

13. A speech coding and decoding system as set forth in claim 1, wherein said speech coding system further comprises:

an LPC analyzing means for calculating LPC parameters for the input sound signal by use of a linear prediction analysis method in a speech interval, according to the judgment by said first speech/no-speech sound judging means, a unique word generating means for supplying a unique word control signal for discriminating between a speech interval and a no-speech interval in a coded signal supplied from said coding processing means, wherein said switch control means supplies a coded speech signal generated by said coding processing means as well as a unique word control signal indicating a speech interval, which is supplied from said unique word generating means, during a speech interval, and supplies a noise signal generated by said coding processing means as well as a unique word control signal indicating a no-speech interval, which is supplied from said unique word generating means, during a no-speech interval, according to the judgement by said first speech/no-speech sound judging means, and said first filtering means comprises:

a low pass filter for filtering the information other than a speech of the input sound signal, and said speech decoding system comprises:

a second speech/no-speech sound judging means receiving a coded signal supplied from a switch control means of the speech coding system for discriminating between a speech interval and a no-speech interval, based on the unique word control signal included in the input coded signal, and an LPC decoding means for calculating LPC parameters based on the input coded signal for a speech interval, according to the judgement by said second speech/no-speech sound judging means, and said second filtering means comprises:

an LPC storing means for temporarily storing the LPC parameters calculated by said LPC decoding means, and a high pass filter for filtering the speech signal decoded by said decoding processing means, by use of the LPC parameters stored in said LPC storing means as a filter coefficient.

* * * * *